US005320056A

United States Patent [19]

Marinzoli

[11] Patent Number: 5,320,056

[45] Date of Patent: Jun. 14, 1994

[54] RECESSED BOTTOM TANKER

[76] Inventor: Carmelo L. Marinzoli, 28 Bala St., Cherry Hill, N.J. 08002

[21] Appl. No.: 878,035

[22] Filed: May 4, 1992

[51] Int. Cl.[5] ..... B63B 25/08

[52] U.S. Cl. ..... 114/74 R; 114/125

[58] Field of Search ..... 114/72, 74 A, 74 R, 114/74 T, 65 R, 121, 77 R

[56] References Cited

U.S. PATENT DOCUMENTS

| | | | |
|---|---|---|---|
| 323,831 | 8/1885 | Swindell | 114/61 |
| 681,962 | 9/1901 | Goulaeff | 114/65 R |
| 1,266,469 | 5/1918 | Hornbeck | 114/39.1 |
| 2,348,783 | 5/1944 | Brunt | 114/61 |
| 2,953,113 | 9/1960 | Baer | 115/42 |
| 3,881,438 | 5/1975 | Jones, Jr. | 114/66.5 |
| 3,938,457 | 2/1976 | Dwyer | 114/74 R |
| 3,995,575 | 12/1976 | Jones, Jr. | 114/56 |
| 4,048,939 | 9/1977 | Jones, Jr. | 114/125 |
| 4,232,623 | 11/1980 | Chou et al. | 114/125 |
| 4,366,766 | 1/1983 | Bergman | 114/125 |
| 4,658,764 | 4/1987 | Ingvason | 114/56 |
| 4,919,063 | 4/1990 | Hall et al. | 114/56 |

FOREIGN PATENT DOCUMENTS

| | | | |
|---|---|---|---|
| 0453013 | 10/1991 | European Pat. Off. | 114/74 R |

OTHER PUBLICATIONS

A. Hirai, Philadelphia Section Society of Naval Architects and Marine Engineers, "Mid-Deck Tanker: A Proposal for Future Tanker Designs from the Pollution Prevention Point of View" (Feb. 19, 1992).

International Maritime Organization (IMO), Marine Environment Protection Committee-32nd Session, "Prevention of Oil Pollution" (Mar. 1992).

Committee on Tank Vessel Design, *Tanker Spills: Prevention by Design* (National Academy Press: Wash. D.C. 1991).

*Primary Examiner*—Edwin L. Swinehart

*Attorney, Agent, or Firm*—Synnestvedt & Lechner

[57] ABSTRACT

Recessed bottom tankers. Vessels described herein are built or retrofitted with side ballast tanks and optional forward bulbs extending to a level below the level of the vessel's cargo compartment to protect the cargo in case of collision or grounding. When compared to a double-hull or mid-deck design, the devices disclosed herein will considerably reduce the cost of a new tanker construction and make the retrofitting of some old single-hull ships economically acceptable. Furthermore, ballast tanks and bulbs designed in accordance with the present invention greatly reduce the possibility of ballast contamination and the risk of explosion due to oil leakage into ballast spaces as in double-hull designs. By eliminating the double bottom under the cargo compartments (as in the double-hull design) as well as the lower tanks (as in mid-deck design) and providing direct access from the deck to all ballast spaces, this invention substantially facilitates inspections, surveys, cleaning and maintenance procedures as well as simplifying piping arrangements with considerable benefits to the vessel's operation.

4 Claims, 8 Drawing Sheets

RECESSED BOTTOM TANKER

FIELD OF THE INVENTION

This invention relates generally to novel designs for waterborne vessels. More particularly, this invention relates to novel vessels, especially tankers, which are designed to reduce the possibilities of water pollution due to spills of contaminant cargo and fuel following collision or grounding.

BACKGROUND OF THE INVENTION

Since the beginning of the oil industry, large volumes of crude oil and petroleum products have been carried on tankers and barges, usually in single hulled vessels of which a typical longitudinal and mid-ship transversal section is schematically indicated in FIG. 1A and 1B. In the great majority of tankers and barges operating today, the cargo and fuel is still separated from the surrounding water by a single barrier of steel plating which together with the internal structural members are adequate in terms of strength and rigidity for transporting cargo, but offer minimal protection of the environment from cargo and fuel oil spills in case of collision or grounding.

The international maritime community has dealt successfully with the problem of pollution caused by discharging overboard of the ballast water contaminated by oil residue. Until recent times however no provisions existed which were intended to prevent, or minimize, the pollution caused by cargo and fuel oil spills as the result of collision or grounding.

Numerous tanker disasters and ensuing oil spills in recent times however have caught the attention of the world (S.S. Terry Canyon, S.S. Amoco Cadiz, S.S. Corinthos to name just a few) and maritime community regulators have reacted by issuing new rules and regulations aimed at enhancing navigation safety as well as providing some structural protective measures. Thus, so-called "protectively located segregated ballast tank" arrangements for tankers are now mandatory. Unfortunately, all these measures proved inadequate and the need for more stringent regulations became evident in light of the Exxon Valdez and other more recent environmental disasters.

In 1990, the U.S. Congress enacted a law requiring that all new tankers operating in U.S. waters be built with double sides and double bottoms extending the full length of the cargo spaces—the so-called "double-hull" ships. This design in effect interposes two structural barriers separated by voids or spaces (which can also function as ballast tanks) between the cargo of oil and the waterway. FIG. 2A and 2B illustrates a typical double-hull design. U.S. law also now requires that existing single hull vessels, unless modified to suit the required double-hull arrangement, be phased out and scrapped when they reach a predetermined age.

In March 1992, the International Maritime Organization (IMO) endorsed the double-hull concept, and also accepted, as an alternative design, the so-called "Mid-Deck Ship" in which protection against pollution following collision is obtained by means of side (wing) tanks, the same as in the double-hull design, while protection against pollution following grounding is achieved by utilizing the hydrostatic pressure of the water outside the hull to force the oil or other petroleum products in the ruptured tank into another compartment in the tanker. The mid-deck design is illustrated in FIG. 3A and 3B. A description of a mid-deck design is found in A. Hirai, *Mid-Deck Tanker: A Proposal for Future Tanker Designs from the Pollution Prevention Point of View,* presented at the Philadelphia Section Society of Naval Architects and Marine Engineers, Feb. 19, 1992, the teachings of which are specifically incorporated herein by reference.

The maritime community recognizes that the above-mentioned designs do not represent ideal solutions. The double-hull design is complicated structurally and expensive to implement even in newly constructed tankers. It requires the use of considerable amounts of steel plates, beams and pipes, and greatly increases the weight of the vessel and its operating costs. It also incurs other operational and personnel safety problems, namely: cleaning, surveying, and risk of explosion. Furthermore, while the double-hull design appears to be satisfactory in case of low energy grounding, it may even prove detrimental in case of a high energy impact similar to the one sustained by the Exxon Valdez, since when the outer hull is ripped open, the void tends to fill with water, increasing the tanker's draft, thereby causing more petroleum product to spill if the inner hull is also pierced.

Conversely, the mid-deck concept will probably greatly reduce the spill in case of high energy grounding, but will not be very effective in a low energy accident when the cargo is denser than the water or when the cargo will first mix with the water to form a dangerous pollutant. Furthermore, the mid-deck design creates the same expensive steel requirements as the double-hull. The mid-deck design is simple in principle but complicated in reality, has not been tested, and requires serious structural modifications not easily implemented on an existing ship.

Furthermore, for existing tankers, the costs of retrofitting an old vessel with a double hull will be prohibitive, and would therefore force the retirement of such vessels. For these and other reasons, IMO and the U.S. Government have left the door open and will consider any other proposals that offer comparable protection and avoid some of the shortcomings of the two, so far accepted, designs.

Accordingly, it is an object of this invention to provide a new, safer, easy to maintain, more efficient and more economical hull design for waterborne vessels, particularly oil tankers, which will reduce the probability of serious oil or other contaminant spills and environmental pollution as the result of collision or grounding. This new hull design is easily implementable for new vessels and will not significantly increase the overall cost of construction. Furthermore, the new hull design will allow retrofitting of existing single hulls to bring them into compliance with national and international safety and antipollution regulations. Both of these goals are accomplished in an economical manner and without unduly increasing the weight of the vessel. Heretofore, these objectives and advantages have not been satisfactorily achieved with existing or presently proposed hull designs.

SUMMARY OF THE INVENTION

These objectives and advantages are obtained in accordance with the present invention by a hull design for a single hull waterborne vessel that will protect the environment from pollution by its cargo and fuel oil in case of collision or grounding and which comprises a vessel having ballast tanks on each side thereof outboard of centrally located cargo and fuel oil storage compartments said ballast tanks extending longitudinally for at least the full length of the cargo and fuel oil storage compartments and vertically from a level above the waterline to a depth below the bottom of the vessel that is immediately under the cargo and fuel oil storage compartments.

A vessel constructed or retrofitted in accordance with the present invention involves considerably less costs in new vessel construction due to the lesser amount and weight of steel plate, framing and piping which will be required to construct or convert the vessels as compared to the double-hull or mid-deck designs. Furthermore, vessels designed in accordance with the present invention have uniquely configured tanks which protect the cargo and fuel oil storage tanks in cases of grounding and collision and which are much safer and are easier to clean, maintain, ventilate and inspect when compared to the double-hull and mid-deck designs since the ballast tanks are not located below the cargo tanks and are easily accessible directly from deck level.

Vessels constructed in accordance with the present invention are structurally less complex in design than double-hull and mid-deck ship designs since standard construction techniques can be utilized which are no more complex than presently used in the fabrication of "bulbous" bows or stern sections having reinforcing structures at defined critical points on the hull. Cargo piping and compartment washing and ventilation systems in vessels constructed in accordance with the present invention will be simpler in design and easier to operate and maintain than those used in double-hull and mid-deck designs. In the case of retrofitting an existing ship with ballast tanks arranged and constructed in accordance with the present invention, the retrofitting can be with prefabricated units, thereby reducing dry-dock time.

Another advantage of a vessel having a hull design made in accordance with the present invention is the reduction in area of the plating at the interface between cargo tanks and ballast tanks, and the concurrent reduction of the probability of leakage occurring between the cargo compartments and the ballast tanks, thereby reducing the risks of explosion and the possibilities of ballast or cargo contamination.

The objectives and advantages of the present invention have not been achieved by prior vessel designs, such as the double-hull and mid-deck designs which have attempted to minimize environmental damage resulting from cargo and oil spills following collision or grounding.

The objects and advantages of the present invention will be better understood when considered with respect to the following detailed description of the invention, and the accompanying drawings.

DETAILED DESCRIPTION OF PREFERRED EMBODIMENTS

Figure 1A:
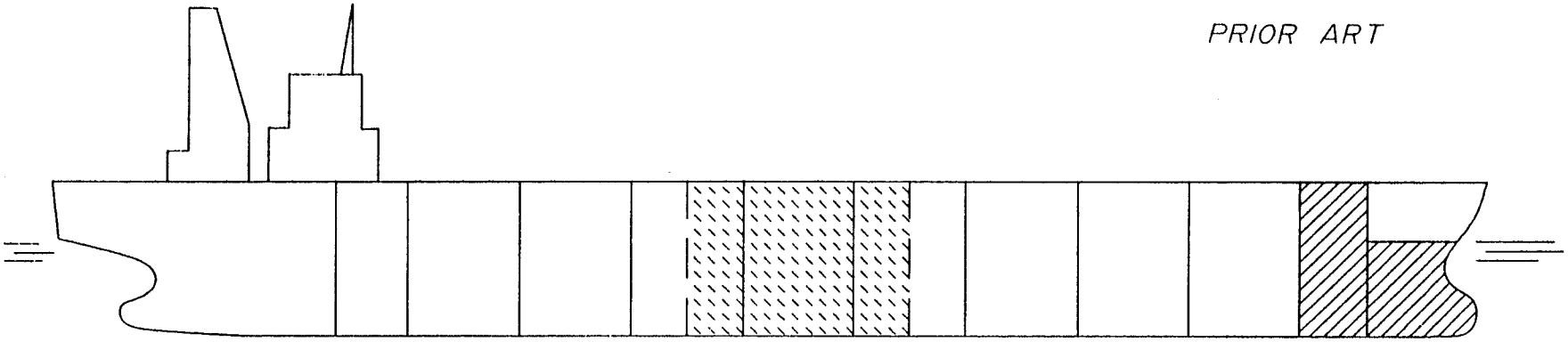
FIGS. 1A and B contain schematic drawings of the longitudinal and mid-ship transversal tanker built with a single hull, and protectively located segregated ballast tanks.
Figure 1B:
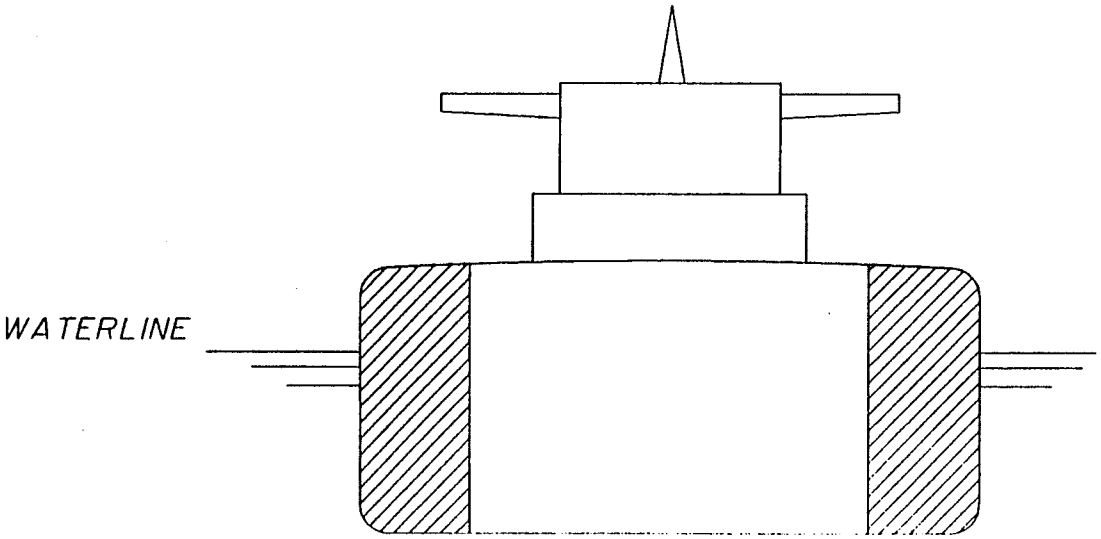
Figure 2A:
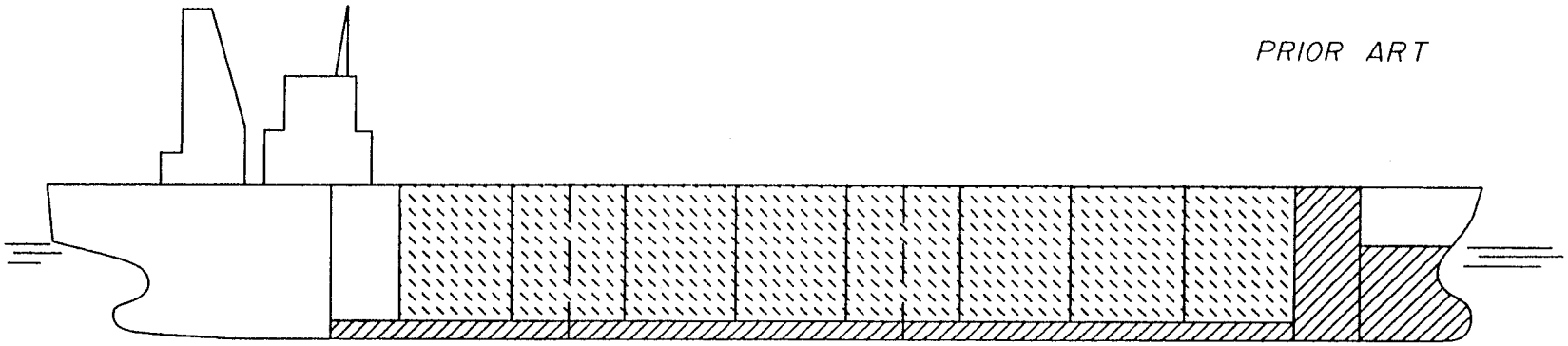
FIGS. 2A and B contain schematic drawings of the longitudinal and mid-ship transversal sections of a prior art double-hull tanker.
Figure 2B:
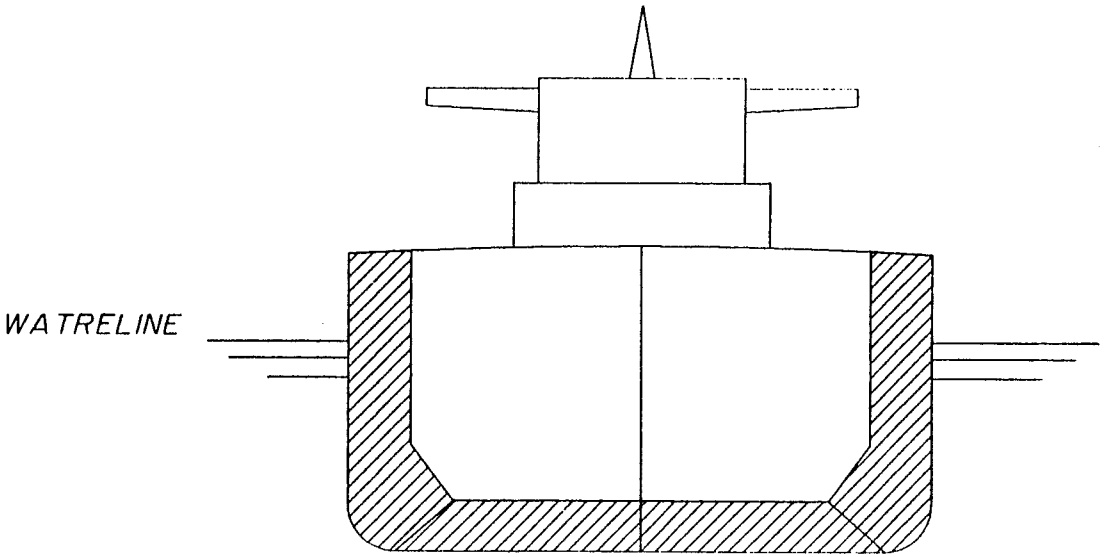
Figure 3A:
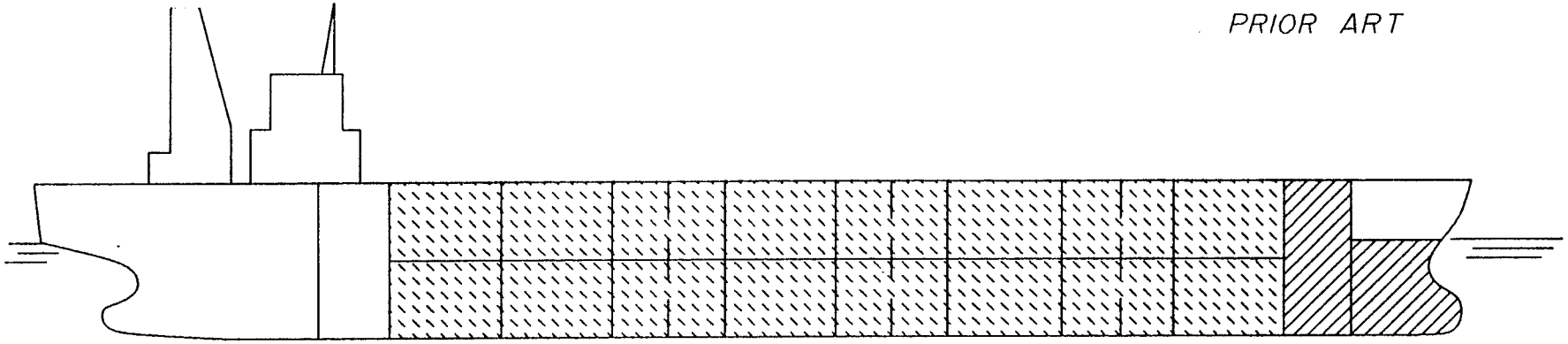
FIGS. 3A and B contain schematic drawings of the longitudinal and mid-ship transversal sections of a prior art mid-deck tanker.
Figure 3B:
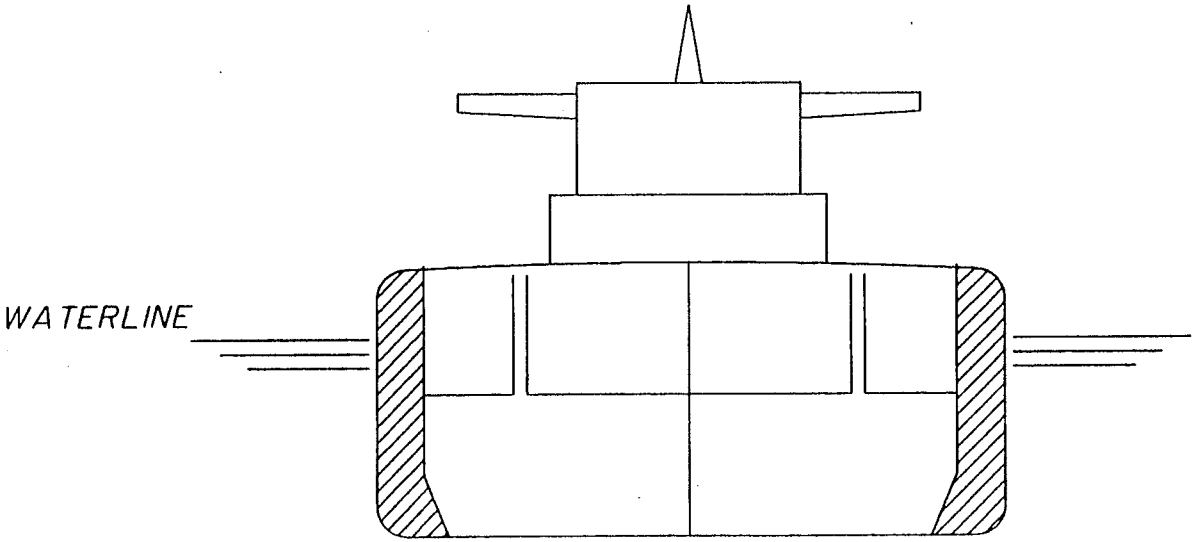
Figure 4A:
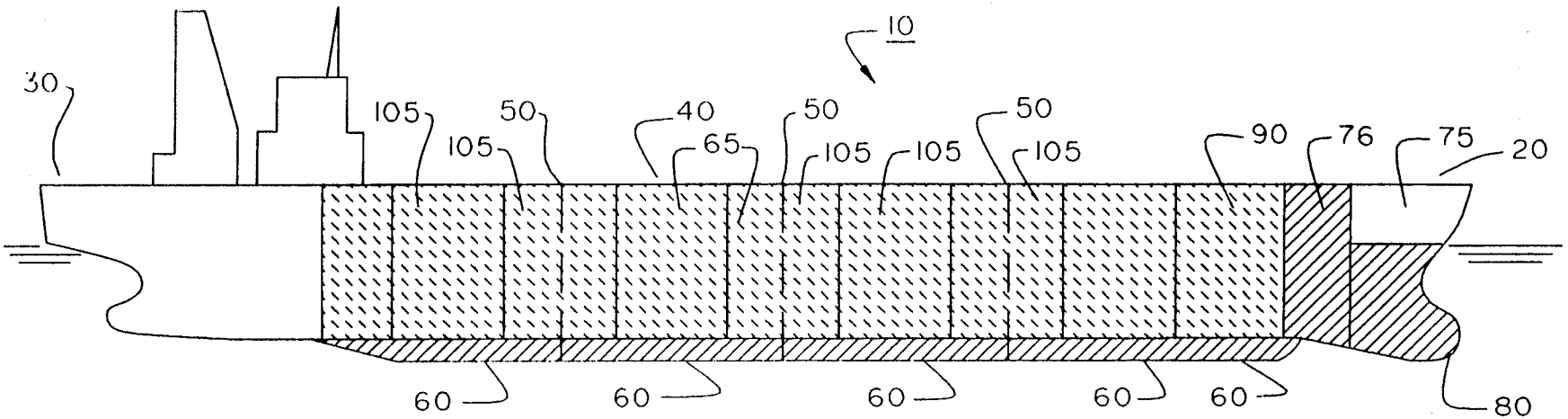
FIGS. 4A and B contain schematic drawings of the longitudinal and mid-ship sections of a recessed bottom tanker in accordance with the present invention having extended side ballast tanks and also having a forward ballast bulb to protect cargo compartments in case of collision or grounding.
Figure 4B:
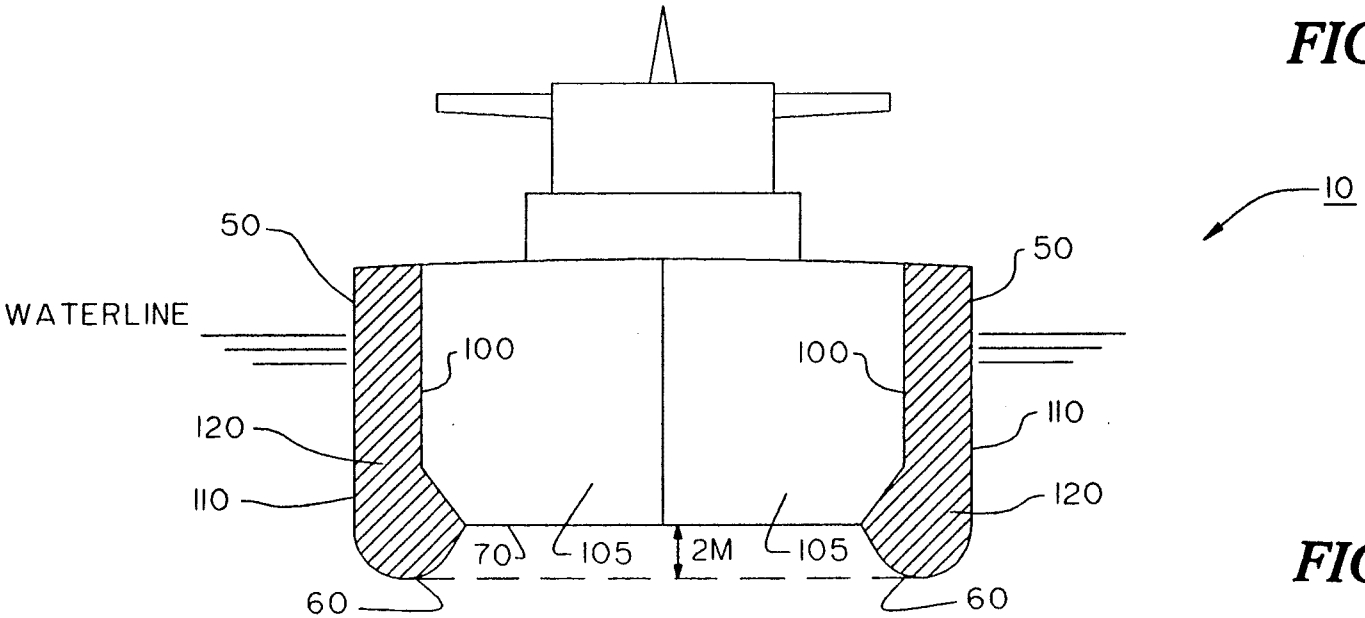

Referring now to the drawings wherein like reference numerals refer to like elements, the schematics of FIG. 4A and 4B show a vessel generally at 10 provided in accordance with the present invention. In a preferred embodiment, the vessel is an oil tanker. However, it will be recognized by those with skill in the art the invention could be utilized in other vessels such as ore/oil bulk carriers ("OBO") as well as in oil carrying barges, and even by some naval and passengers vessels. For simplicity, the remainder of this detailed description will be made with reference to a tanker.

In general, tanker 10 comprises a forward section shown generally at 20, an aft section shown generally at 30, and a mid-section shown generally at 40 which usually comprises the cargo and ballast compartments or tanks, and may also comprise fuel storage tanks for the tanker. As used herein, the term "cargo" refers to any material in the tanker 10 which could cause environmental pollution if spilled, or which is an environmental contaminant. For further convenience, the cargo referred to throughout the remainder of this detailed description will be oil. In accordance with the present invention, protection of the cargo in case of grounding is achieved by extending the depth of the side ballast tanks 50 to protect against collision with underwater obstacles with an appendage 60 so that the ultimate bottom of ballast tanks 50 are located well below the bottom of cargo compartments 70 which form a part of the hull of tanker 10. In the case of a "low energy grounding," that is, when the tanker is either moving very slowly or comes gently to rest on the ocean bottom, it is expected that only the appendages 60 of the ballast tanks 50 will be damaged or perforated by any undersea obstacles and that no oil will escape from the elevated or recessed cargo tank bottoms 70.

The minimum width of ballast tanks 50 is defined by existing regulations. The minimum depth of the appendages 60 will also be regulated by national and international agencies, but in no event will be less than about two meters. The two-meter depth as shown is measured from the bottom of the cargo compartments 70 to the bottom of the appendages 60. However, depending upon the size of the tanker, its intended service and total ballast requirements, the two-meter distance may increase, especially in view of the desired size and configuration of the ballast tanks 50 and since the cargo and ballast requirements for tanker 10 may vary.

The front portion 20, or bow, of tanker 10 can further be constructed in accordance with the present invention to enhance protection of the cargo in case of high energy grounding. In general, bow 20 comprises a storage area 75 and a forward ballast tank (deep tank) 76 under which a standard bow bulb (not shown) may sometimes be located. In this embodiment a larger bulb 80 can be attached directly below the fore peak and deep tank 76. In a further preferred embodiment, the bottom of the forward bulb 80 when installed will be level with the bottom of side ballast tanks 50.

When installed, bulb 80 is intended to bear the brunt of a frontal impact and further contribute to stopping vessel 10, or at least slowing the vessel after impact. When a high energy grounding occurs, it is expected that forward bulb 80 will be heavily damaged. However, since in no case will oil be carried in the compartment 75 above bulb 80, even complete destruction of bulb 80 should not cause oil to leak from tanker 10. If the grounding is so powerful as to completely destroy bulb 80, and damage the side tanks' appendages 60, it will at least function to reduce the energy of the grounding so that only minimal damage may occur to the bottom of the forward cargo compartment 90 resulting in greatly reduced oil spillage. Frontal bulb 80 may have different configurations depending upon the particular tanker which it is mated to, and the particular preferences of owners and regulatory bodies. Bulb 80 may be short and wide, or long and narrow, or be made part of and attached to appendages 60 to provide additional side protection. In still further preferred embodiments, bulb 80 may become part of a centrally located ballast tank extending aft for a good portion of the vessel.

As has been mentioned previously, the overall design advantages of recessed bottom tankers provided in accordance with the present invention can be incorporated into new ships as desired. When a new ship is built with ballast tanks and appendages as described herein, the ballast tanks will have an inner surface 100 running the entire length of the cargo compartment and which form walls or bulkheads for the cargo compartments, shown generally at 105. The outer surface 110 is the outer skin for the tanker 10. In between the inner and outer surfaces ballast spaces 120 are formed which are empty when the vessel is loaded with cargo in the cargo compartments 90 and 105, and which may be filled with seawater when the cargo compartments are unloaded or empty so that the seawater provides ballast to tanker 10. In case of retrofitting an existing ship, appendages 60 will preferably be attached to a flat plate (not shown) which is first welded to the hull of tanker 10. Because the appendages 60 will be welded to the flat plate, it is expected that the appendage will tend to rip off the flat plates and peel away from the hull in a high energy grounding and leave the hull and cargo compartments intact.

In a retrofitting situation, the inner surface 100 may be built as a bulkhead in cargo compartments 90 and 105 and appendages 60 will be welded at the appropriate locations on the hull to create the entire ballast tanks 50. In a further preferred embodiment, appropriate openings will be provided in the portion of the cargo compartment hull which is closed off by the new longitudinal bulkheads so that sufficient access is assured to the ballast tanks 50 and appendages 60 for the purpose of maintenance, cleaning and surveys. In still further preferred embodiments and especially in the retrofitting scenario, it will be possible to fabricate entirely new side ballast tanks complete with extended bottom appendages and internal stiffening structures, and weld them directly to the shell of the existing tanker.

In any of these embodiments, the thickness of the plates and the internal structure, as well as the method of welding attachments or new steel to old steel in the existing tankers, will be in accordance with the rules and requirements of the appropriate regulatory body. The resulting structure will be such that in the case of high energy grounding, the resulting "tearing" effect will apply only, and be limited to, the plating of the ballast tanks' appendages 60 which will "peel off" without damaging the plates enclosing the vessel's cargo compartment.

The advantages of this construction are apparent. First, the bulkhead areas between the cargo compartments and the ballast tanks will be significantly reduced, thereby proportionally reducing the probability of leakage of petroleum products into the ballast tanks 50 from the cargo compartments 90 and 105. This in turn will reduce the possibilities of explosion or ignition of leaked petroleum product into the ballast spaces, and also greatly reduce the possibilities of cargo or ballast contamination. Furthermore, since the ballast tanks 50 do not extend under the cargo compartments 90 and 105, this invention greatly reduces the labor costs and hardship associated with the cleaning, surveying, maintenance, and repairing of the ballast spaces 120.

Also, it is apparent that the design of ballast tanks and appendages in accordance with the present invention will greatly reduce the steel costs associated with building tankers described herein as compared to the double-hull or mid-deck ships. Thus, in either the retrofitting application or in the design of new tankers, ballast tanks with bottom appendages provided in accordance with the present invention will reduce the overall cost of the ship. Such results have not heretofore been achieved in the vessel design art, and evince highly significant advantages over prior mid-deck, double-hull, and other designs.

Figure 5A:
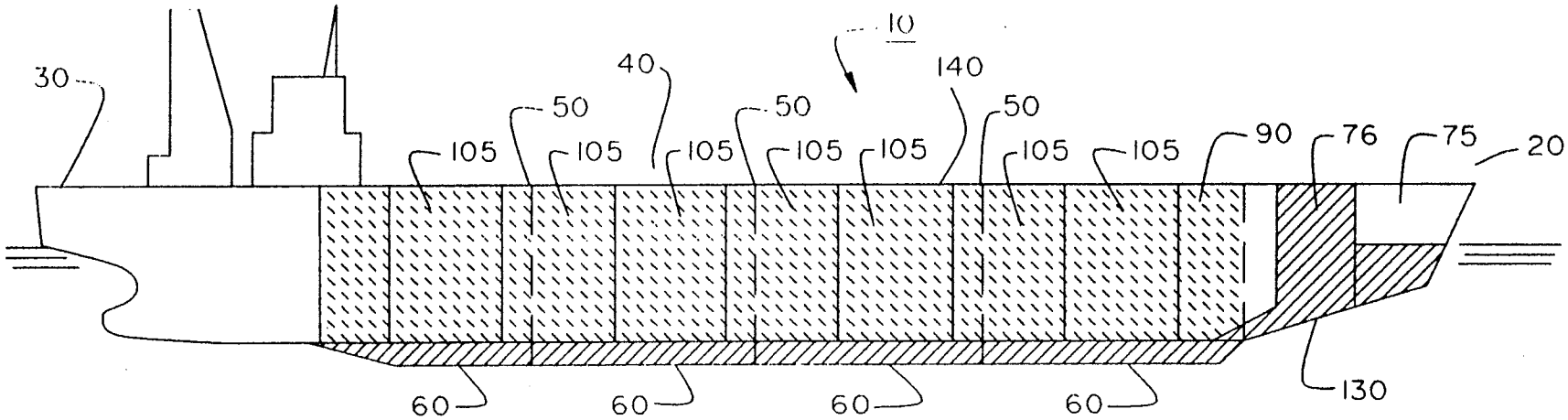
FIGS. 5A and B contain schematic drawings of the longitudinal and mid-ship sections of a recessed bottom tanker in accordance with the present invention having an "icebreaker" bow and extended ballast tanks to protect the cargo in case of collision or grounding.
Figure 5B:
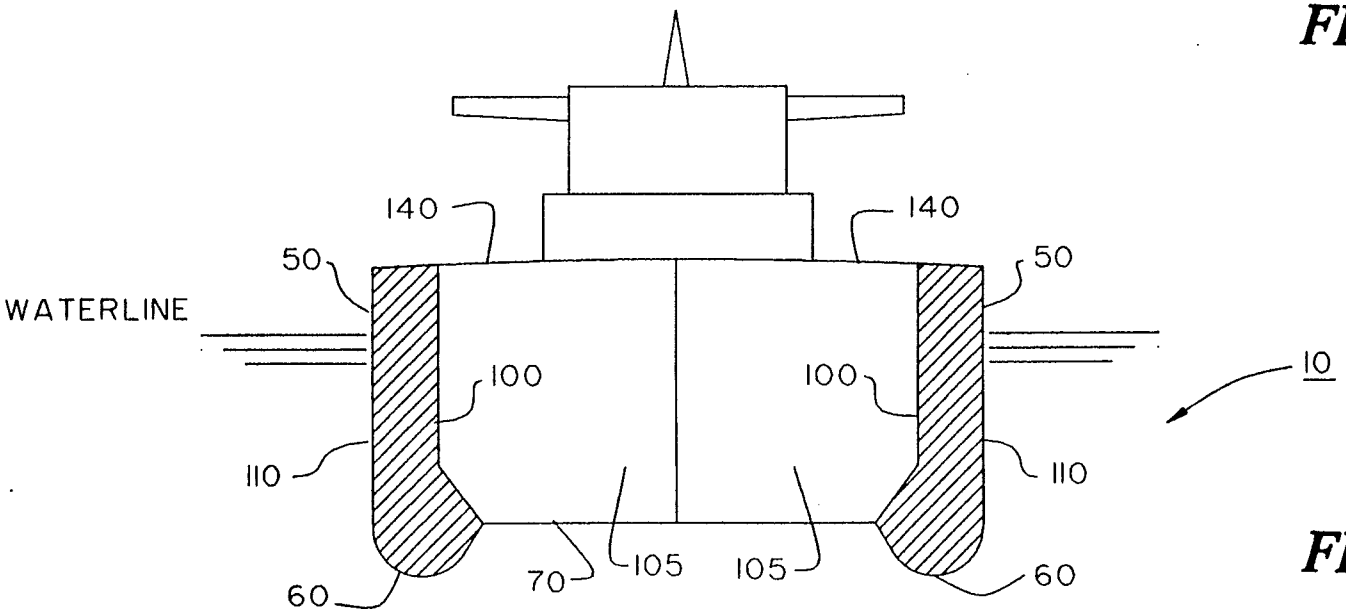
Figure 6A:
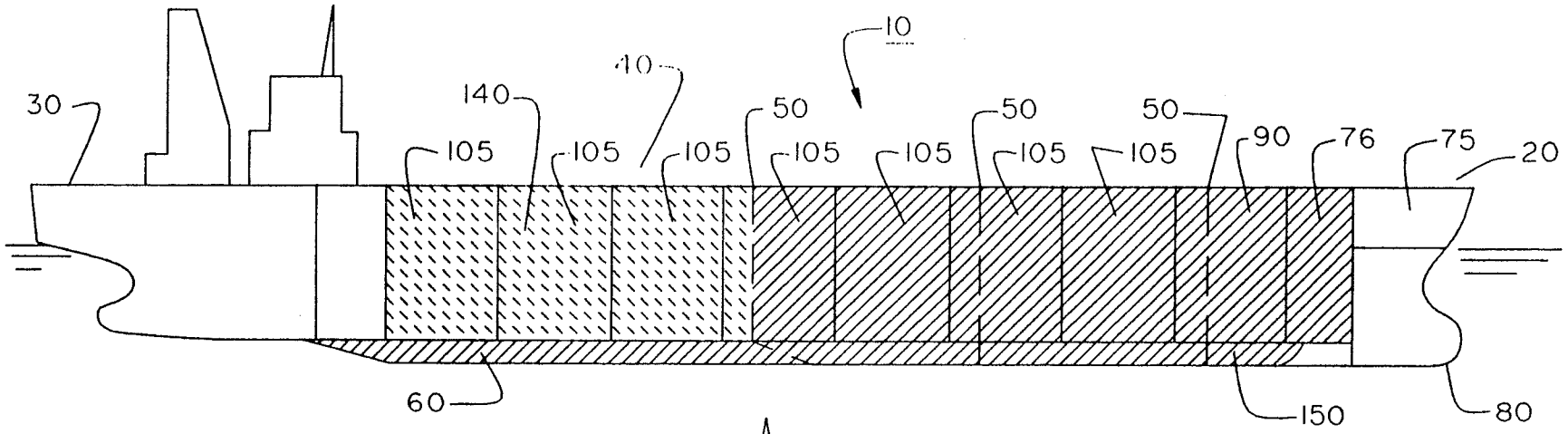
FIGS. 6A and B contain schematic drawings of the longitudinal and mid-ship sections of a recessed bottom tanker in accordance with the present invention having extended ballast tanks, one series of which is formed in the center of the tanker.
Figure 6B:
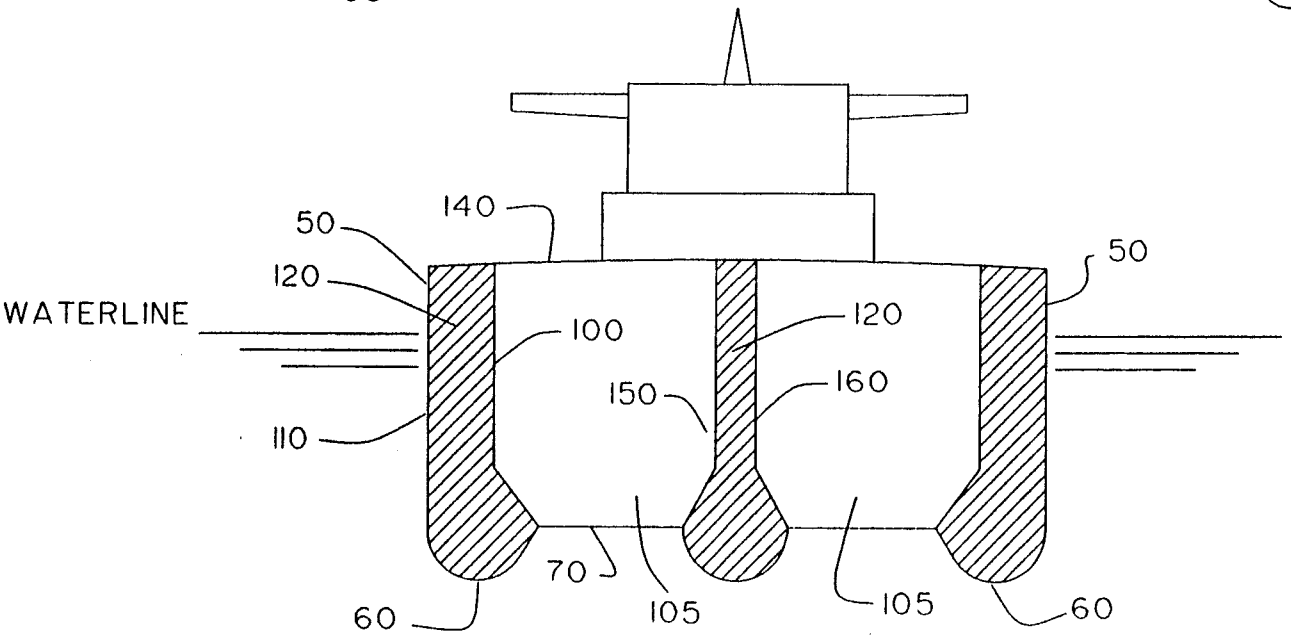
Figure 7A:
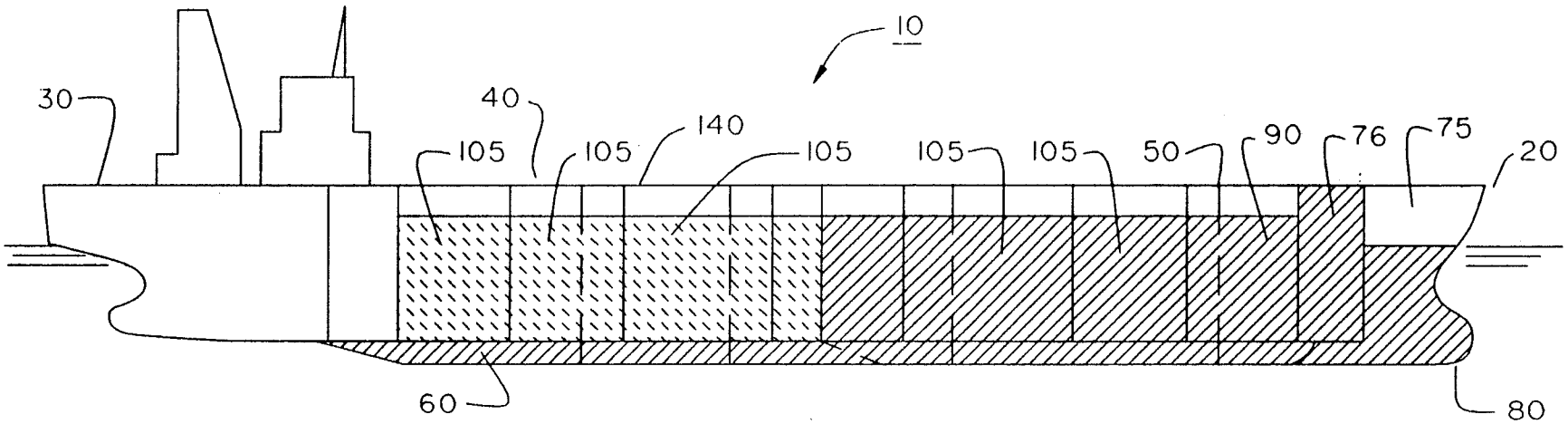
FIGS. 7A and B contain longitudinal and schematic sections of further preferred embodiments of recessed bottom tankers provided in accordance with the present invention.
Figure 7B:
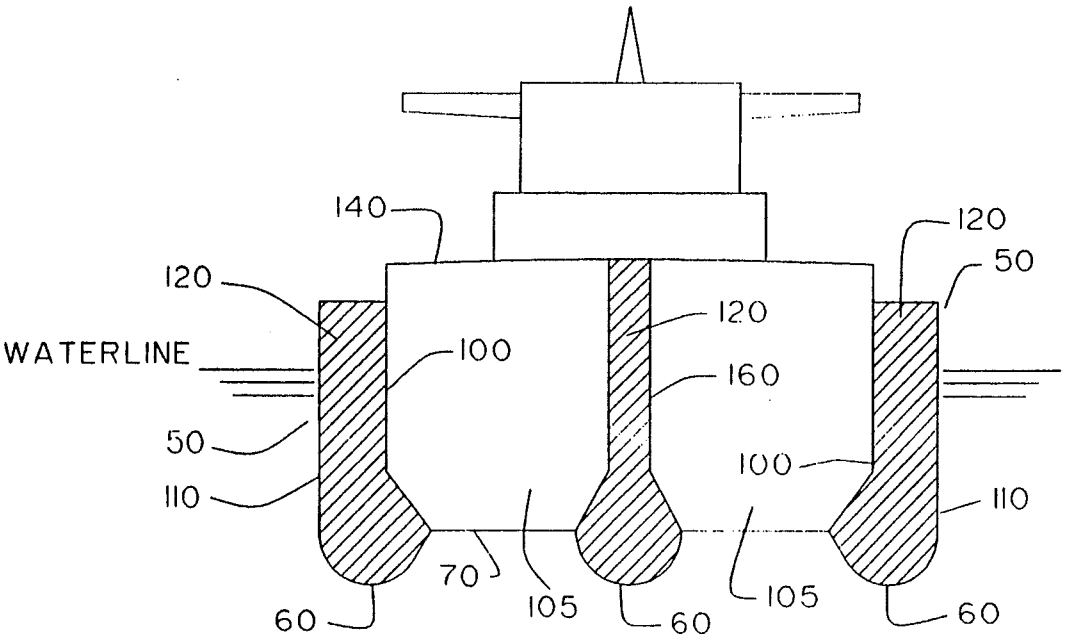

Referring now to FIG. 5A and 5B, another possible embodiment of a tanker utilizing ballast tanks provided in accordance with the present invention is shown. In this embodiment, the tanker does not comprise a forward bulb, but instead is fitted with an "icebreaker" style bow which tends to ride untouched over submerged obstacles in the water until the side tanks' appendages 60 come in contact with them. In the "icebreaker bow" embodiment described herein, the bow or front portion 20 of tanker 10 has a pronounced slope 130 which allows the bow to ride untouched in the water over submerged obstacles. Thus in a high energy grounding, only the lower appendages 60 would come into contact with a destructive underwater obstacle and would be damaged or peeled away, thereby protecting the cargo compartments from piercing. Again, appendage 60 will tend to reduce the momentum of the vessel in a high energy grounding situation providing further protection to the cargo compartments.

It will be apparent to those with skill in the art that the upper portions of the ballast tanks 50 also protect the cargo compartments from the effects of collision. In a preferred embodiment, ballast compartments 50 run from the top deck 140 of tanker 10 to at least two meters or more below the cargo compartment hull 70. This allows easy access to the entire ballast tanks 50 from deck 40 to accomplish the required inspection and cleaning operations. Access is thus provided to the entire ballast tank structure, from the top of the deck 140 through the bottom of appendages 60.

Figure 8:
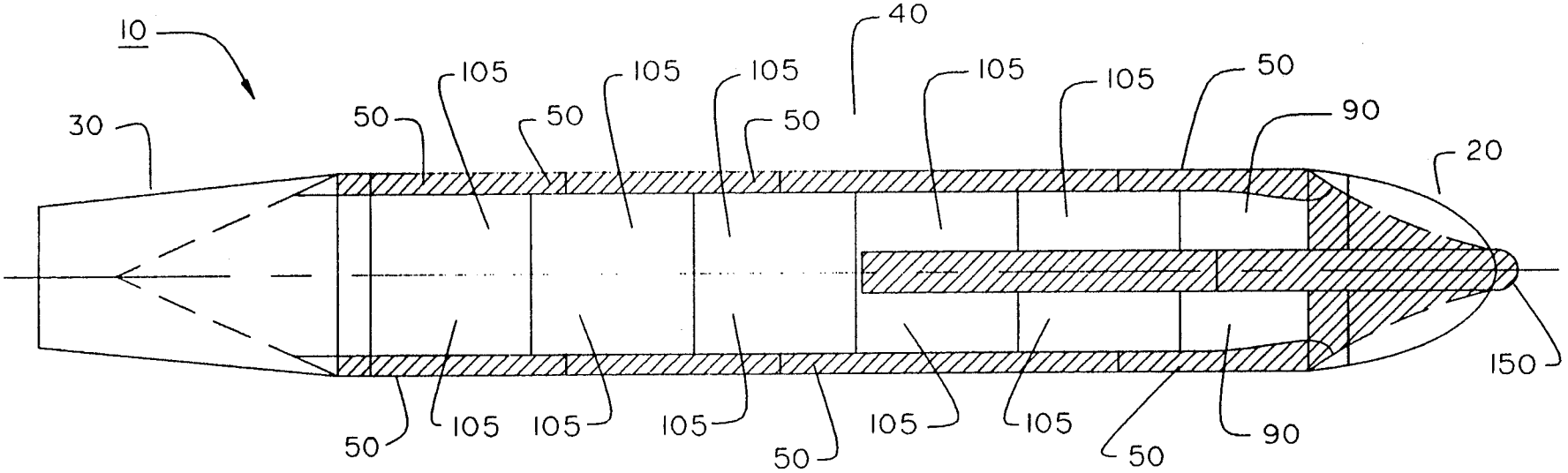
FIG. 8 is a plan view of the tanker of FIG. 7A and 7B.

In case of very large crude oil carries ("VLCC") or ultra-large crude oil carriers ("ULCC") where the width of the cargo tanks (and consequently the recessed bottom) is much larger, it would be possible to add a centrally located series of ballast tanks 150, complete with bottom appendages 60 and incorporating the forward bulb 80 to further enhance the protection of the cargo in case of grounding as shown in FIGS. 6A, 6B, 7A and 7B. In this embodiment, the centrally located ballast tanks 150 can extend from the bow 20 to the aftermost section of the cargo compartment, similar to the wing tanks, or be limited to a fraction of the ship's length as best seen in FIG. 8. Internal bulkheads 160 are similarly constructed to create the ballast space 120 of centrally located ballast tank 150. Further, in the embodiment of FIG. 7A and 7B, the ballast tanks 50 do not reach the deck 140, but are above the waterline. In either case, the "sacrificial" appendages 60 will be positioned only under the ballast tanks and be accessible from the deck for the routine operations of cleaning, surveying and repairs.

Ballast tanks and appendages provided in accordance with the present invention represent an economically acceptable solution to retrofitting at least some of the existing single-hull tankers. The ballast tanks described herein present much more economically feasible solutions than the proposal to fit existing single hulls with outer skins to provide a double-hull construction, and may therefore prove a sound financial investment in retrofitting eligible older single hull tankers. Another advantage of the ballast tanks described herein is that existing technology can be applied to retrofit older tankers and to design and build new tankers incorporating this design. Such results have not heretofore been achieved in the tanker design art.

There have thus been described certain preferred embodiments of recessed bottom tankers provided in accordance with the present invention. While preferred embodiments have been described and disclosed, it will be recognized by those with skill in the art that modifications are within the true spirit and scope of the invention. The appended claims are intended to cover all such modifications.

What is claimed is:

1. In a waterborne vessel that does not have a double bottom under its cargo compartments for protecting the environment from pollution by its cargo in case of collision or grounding, the improvement comprising the vessel having ballast tanks on each side thereof outboard of centrally located compartments, said ballast tanks extending longitudinally for at least the full length of the cargo compartments and vertically from a level above the waterline to a depth below the bottom of the vessel under the cargo compartments.

2. The waterborne vessel recited in claim 1 wherein the ballast tanks comprise:

an upper portion extending from the level above the waterline to level of the bottom of the cargo compartments; and an appendage connected to the upper portion extending from the level of the bottom of the cargo compartments to a level below the bottom of the vessel under the cargo compartments.

3. The waterborne vessel recited in claim 2 wherein the appendage extends at least two meters below the bottom of the cargo compartments.

4. The waterborne vessel recited in claim 3 further comprising a forward bulb attached to the bow of the vessel to provide further protection of the cargo in case of grounding or collision of the vessel.

* * * * *